US005133166A

United States Patent [19]

Pacione

[11] Patent Number: 5,133,166

[45] **Date of Patent: * Jul. 28, 1992**

[54] STRUCTURAL ASSEMBLY SYSTEM

[75] Inventor: Joseph R. Pacione, Thornhill, Canada

[73] Assignee: Tac-Fast Systems SA, Fribourg, Switzerland

[ * ] Notice: The portion of the term of this patent subsequent to Dec. 4, 2007 has been disclaimed.

[21] Appl. No.: 541,400

[22] Filed: Jun. 21, 1990

Related U.S. Application Data

[63] Continuation-in-part of Ser. No. 268,341, Nov. 7, 1988, Pat. No. 4,974,384.

[51] Int. Cl.[5] ..... E04B 9/00

[52] U.S. Cl. ..... 52/483; 52/250; 52/DIG. 13

[58] Field of Search ..... 52/483, 250, DIG. 13, 52/251, 252, 484, 488

[56] References Cited

U.S. PATENT DOCUMENTS 2,717,437 4/1955 De Mestral .
3,009,235 11/1961 De Mestral .
3,405,430 10/1968 Sidelman .
3,421,188 1/1969 Rock .
3,499,102 3/1970 Giliemot et al. .
3,583,057 6/1971 Kolozsvary .
4,457,510 6/1984 Pertschuk .
4,744,189 7/1988 Wilson .
4,845,910 7/1989 Hanson .

FOREIGN PATENT DOCUMENTS 42708 8/1970 Fed. Rep. of Germany .
2977165 7/1977 Fed. Rep. of Germany .
2744009 12/1979 Fed. Rep. of Germany .

*Primary Examiner*—Richard E. Chilcot, Jr.
*Attorney, Agent, or Firm*—Brian W. Gray; Robert H. Wilkes

[57] ABSTRACT

Re-attachable structural assemblies incorporating complementary area fastening elements comprising hook and loop elements over extended rigid contact surfaces between structural members of an assembly are disclosed for use in the construction industry in relation to: temporary formwork for casting concrete; precast concrete components for permanent installation of finished surfaces; and, fabricated floor and wall systems including joists, sub-floors, and floor covering surface units. The use of synthetic hook and loop attachment systems affords significant savings in time, labor, and frequently in materials, particularly in the temporary formwork application.

14 Claims, 3 Drawing Sheets

STRUCTURAL ASSEMBLY SYSTEM

This application is a continuation-in-part of application Ser. No. 268,341, filed Nov. 7, 1988 now U.S. Pat. No. 4,974,384.

BACKGROUND OF THE INVENTION

1. Field of the Invention

This invention is directed to heavy construction attachment systems, in particular, to a system incorporating major disassembable units and to the units of the system.

2. Background of the Invention

In the construction industry, concrete foundations are commonly manufactured by using formwork into which concrete is poured. This formwork usually consists of re-usable wood and aluminum composite struts and joists which provide a supporting crib-work or lattice for the actual sheathing members onto which the concrete is poured. The sheathing frequently consists of plain or paper faced plywood members. Thus, a substantial plywood sheathing sheet for example ¾ inch ply, having a replaceable paper liner as the casting surface, is usually nailed to an underlying supporting joist having an inset nailing strip. After the concrete has set, the underlying formwork lattice and plywood is removed. Frequently the plywood has to be torn down, owing to the entrainment of the attachment nails into the concrete. Similarly, the face of the plywood may be Penetrated by the concrete and become damaged. The wood nailing strips of the supporting laticework will become damaged over time due to repeated re-use and will have to be replaced. Considerable expenditures in material and labour costs are therefore involved, and valuable resources are used up.

The present method of manufacturing concrete foundations also has a drawback in that seam outlines of the 4×8 foot sheathing sheets, caused by misalignments, gaps and penetrating cement flashings must be ground away where a smooth finished surface is required.

The use of hook and loop elements for the purpose of joining flexible elements is not new. The garment and footwear industries have for many years employed a particular hook and loop type attachment material, commonly referred to by the trade mark VELCRO, for securing the adjacent surfaces of clothing and footwear. However, this material is limited both by the presently available widths, which do not exceed four inches, and by the maximum anchoring force developed by the plastic hook elements. Furthermore, prior usage appears to have been concentrated on the application of this type of fastener in areas where a peeling. wave-like relative movement can be used to attach and detach a pair of complementary hook and loop surfaces, as when opening a garment or a shoe flap or on the installation of decorative, non-structural panels such as shown in Wilson, U.S. Pat. No. 4,744,189 issued May 17, 1988 or room dividers such as shown in Curatolo, U.S. Pat. No. 4,090,335 issued May 23, 1978.

SUMMARY OF THE INVENTION

The present invention provides a building construction having a plurality of rigid standard components for assembly in layered, substantially planer facing relation, a first such standard component manufactured in standard lengths with a first part of a hook and loop fastening system along a surface of the standard component; a second such standard component having a second part of a hook and loop fastening system of complementary attachability to the first part along at least one surface of the second component, so that such components can be cut and fit as necessary in the building construction and engaged with each other by face to face detachable engagement between the first and second parts of the hook and lopp fastening system.

In one embodiment the building component portions may be positioned in substantially horizontally oriented, substantially planar relation.

In a further embodiment the building component portions may be positioned in inclined oriented relation, such as component parts of a partition wall.

In an alternative embodiment the construction may be temporary, having a plurality of layers, with attachment components secured in releasable joining connection between more than one pair of opposed interfaces of the construction layers.

The present invention discloses in one embodiment a system for manufacturing concrete structures in which re-usable hook and loop area fasteners are secured to component portions and used to attach formwork components in face-to-face mutually adherent, detachable relation.

In this embodiment one of the layers on which the formwork is erected may become embeded in and left with the concrete for later use in attaching finishing details such as surface decoration, rugs or wall paper.

The invention further provides an attachment system having releasable connecting elements for adhering to concrete, to enable the provision of removable and substitutable surface finish members in attached relation by way of the connecting elements to the concrete structure. Such surfaces may be walls, floors and/or ceilings.

The invention further provides a building system wherein a layer of first connecting elements is secured in permanently adhered relation to a first access face of a structure, to form an integral part thereof, for use in securing a second reverse face of a complementary structure in secured relation at the interface therewith, having a layer of second fastening elements located at the interface in engaging relation with the first layer of first elements.

Thus, a carpet or other floor covering having suitable fastening elements on the undersurface, or ceiling panels or tiles having appropriate fastening elements on the upper surface may be readily, detachably secured to an appropriate structure. Similarly, wall surfaces for partitions and the like can be attached to a stud system. Also, the elements of the stud system may incorporate such complementary layered fastening elements.

In one embodiment a lattice of supporting members includes at least a first face of a first member in pressing, adjoined relation with a second face of a second member, each member having secured thereto one component portion of a two component connecting means, to form a connecting interface between the members. Such a connection may be used in concrete formwork, or in a permanent floor joist and sub-floor construction, as well as in wall constructions.

In another embodiment, a structural member is provided with a surface connecting means component part in bonded relation to a first surface portion thereof, for use in attaching a second member having a second surface with a complementary surface connecting means in bonded relation thereto, for joinder of the first and the second members.

In another embodiment a structural member having a first surface with a layer of surface connecting means first component parts mounted to a backing sheet and bonded to the member is provided with a removable protective cover secured thereover in protective relation, the protective cover including on one face thereof a layer of surface connecting means second components complementary to the first components of the connecting means, to permit the attachment and removal of the protective cover and exposure of the surface layer of connecting means first components. Such an embodiment may comprise a floor and sub-floor construction, wherein the protective cover remains in place during the completion of construction, so as to protect the surface connecting means therebeneath. Subsequently, a carpet or other covering may be substituted wherein the protected underlying connecting components are utilized to removably secure the covering to the subfloor.

In general, the area fastening elements of complementary hooks and loops are of synthetic material, formulated in layers attached to backing sheets to facilitate area coverage by way of the attachment means, so as to develop the requisite attachment strength.

BRIEF DESCRIPTION OF THE DRAWINGS

Certain embodiments of the invention are described, without limiting the invention thereto, reference being made to the accompanying drawings, wherein;

FIG. 7 is a general view in exploded relation showing the elements of a portion of a partition wall embodying the invention.

DETAILED DESCRIPTION OF PREFERRED EMBODIMENTS

In the making of the p resent invention it will be appreciated that certain inherent deficiencies and limitations of presently available hook and loop fasteners, such as the presently limited width of four inches in the VELCRO product, and the present upper limit on its gross developed joint strength can be overcome by the provision of wide width sheets of the respective hook and loop elements, the development of elements of improved characteristics and the adoption of improved manufacturing processes for the fasteners. An aspect of the components presented is the integration of a hook and loop fastening system into the surfaces of the products. What is described is an incorporation of this system directly into the elements comprising the building system. This aspect is required in order to provide the necessary flexibility of attachment when products are to be transported to the site as standard components or cut and fit on site for assembly into a building.

In addition, the invention presented in this application as well as previous application Ser. No. 148,711 filed Jan. 26, 1988 ANCHOR BOARD SYSTEM are not fastening products per se but rather are new designs of conventional building materials.

Figure 1:
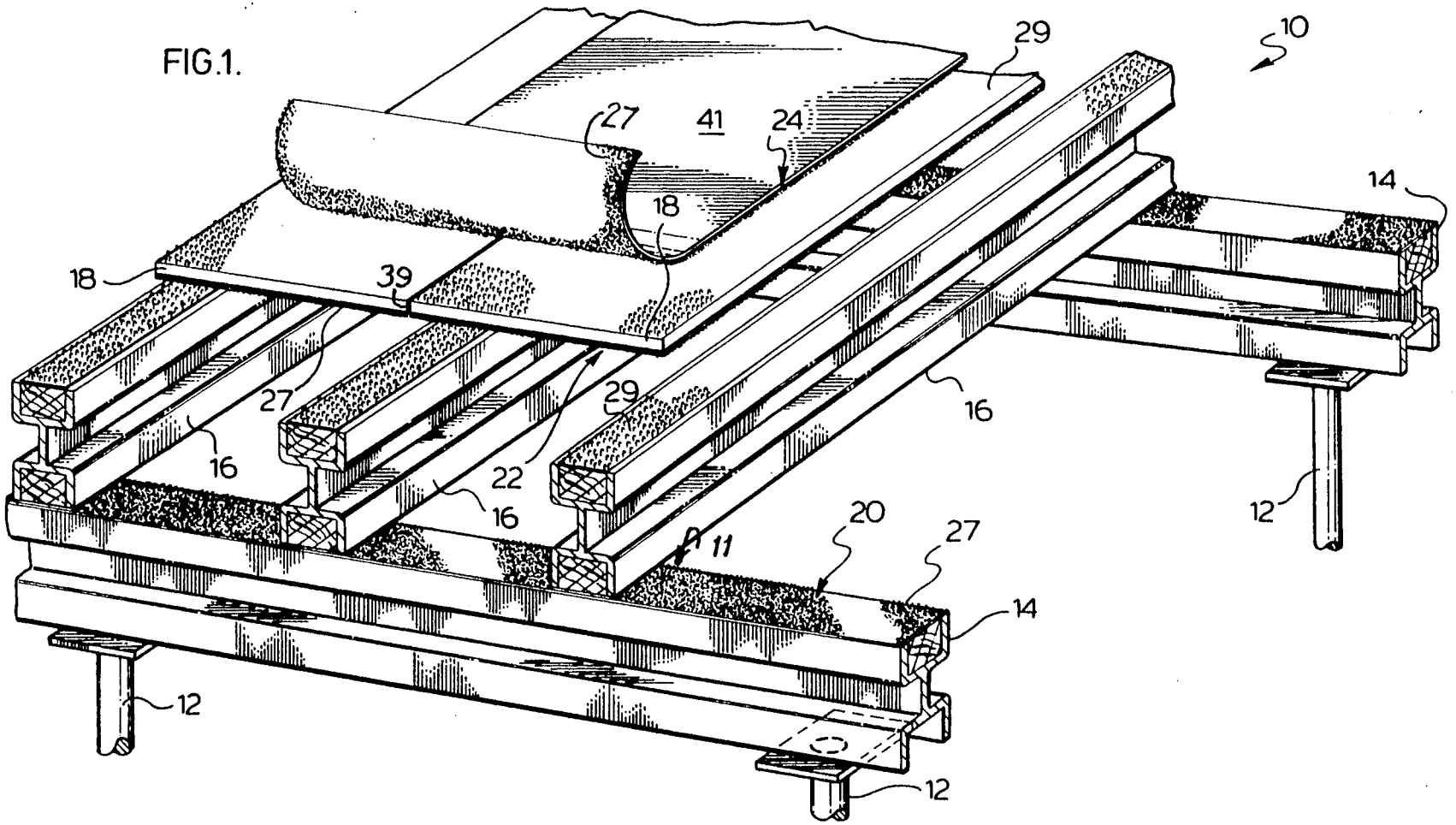
FIG. 1 is a general view of a concrete formwork system in accordance with the present invention, in partially exploded relation.

Referring to FIG. 1, a concrete formwork assembly 10 comprises a number of supporting struts 12 carrying beams 14 across which are laid joists 16, to which sheathing sheets 18 are secured.

A covering 41 overlays the gaps or joints 39 between adjoining sheathing sheets 18. At the interfaces 11, 22, 24 between the respective rigid components 14, 16, 18 area fastening elements comprising loops 27 and hooks 29 are located, to attach the respective components in securely anchored relation.

The covering 41 also utilizes area fastening elements comprising loops 27 and hooks 29 to secure it to the sheathing sheets 18.

Figure 2:
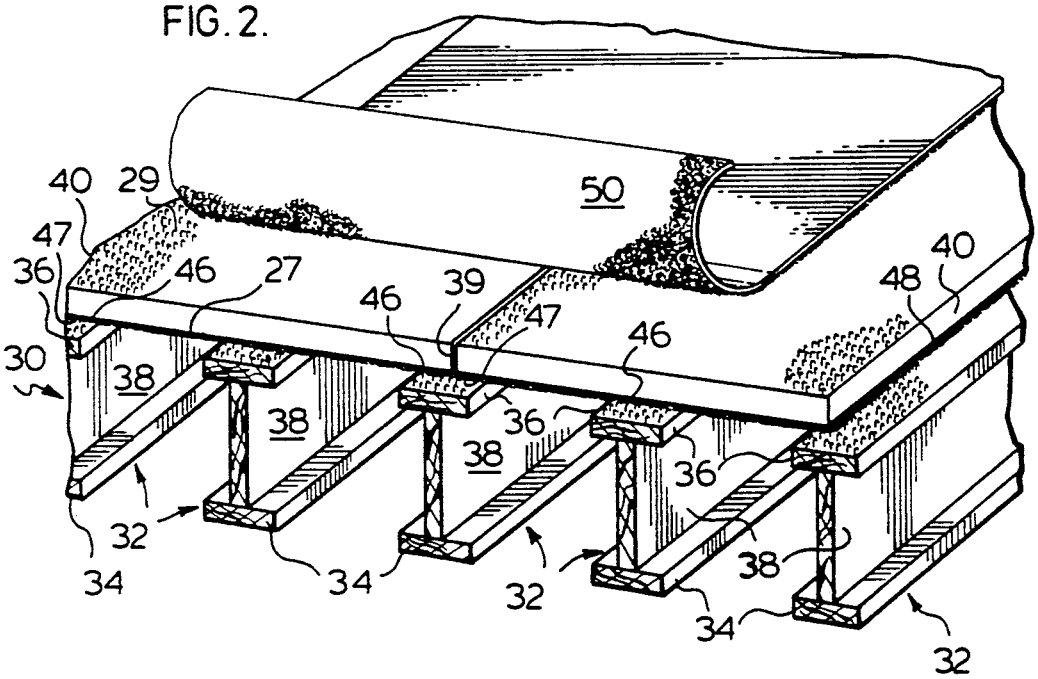
FIG. 2 is a general view of a structural floor system in accordance with the present invention.

Referring to FIG. 2, a portion 30 of a floor construction is shown. Illustrated are fabricated joists 32, each comprising a pair of opposed flanges 34, 36 having a web 38 secured therebetween. Such joists 32 can be of extruded light alloy such as aluminum, or fabricated of metal, or of wood and plywood as indicated.

The ends of joists 32 usually are supported by peripheral basement walls (not shown).

A subfloor comprising panels 40 is supported by joists 32. At the interface contact areas 46 and 47 are located area fastening elements secured to the respective components comprising loops 27 and hooks 29, to hold the respective components in mutually anchored relation. A flexible, protective cover sheet 50 overlies the upper surface of floor panels 40, being arranged to cover the floor panel intermediate gaps or joints 39.

During the erection of a building, sheet 50 may comprise a protective over-flooring element, to safeguard the underlying, upwardly extending hook Portions 29 against damage from above. Once the building is erected and the finishing work completed, the protective sheet 50 can be removed and 4×8 sheets of plywood for a flooring system having a complementary loop layer on the underface thereof or a covering carpet with a looped underface, as disclosed in my copending application Ser. No. 136,953 can be installed.

Figure 3:
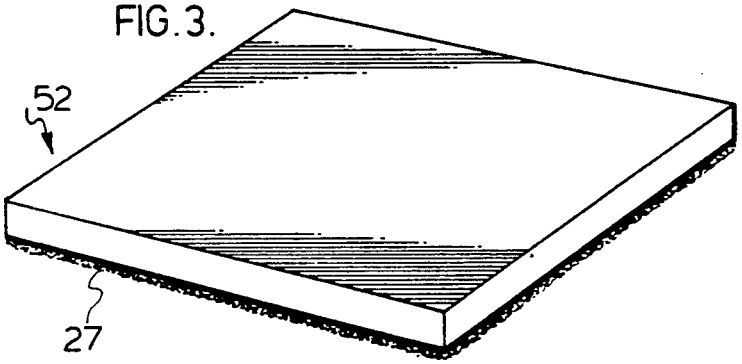
FIGS. 3 and 4 are general views of structural elements incorporating component connecting means in accordance with the invention.

FIG. 3 shows a substantially rigid panel 50 having a layer of loop elements 27 on one face thereof. This panel may comprise a finished surface element, which can be attached to installed hook elements 29 of a construction.

Figure 5:
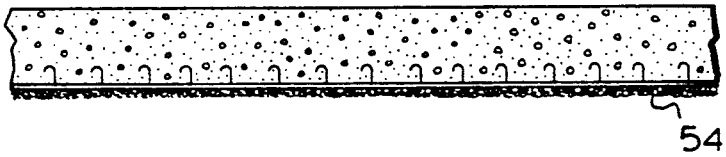
FIG. 5 is a sideview section of a poured ceiling or roof incorporating one element of a connecting means combination in installed relation therewith.
Figure 6:
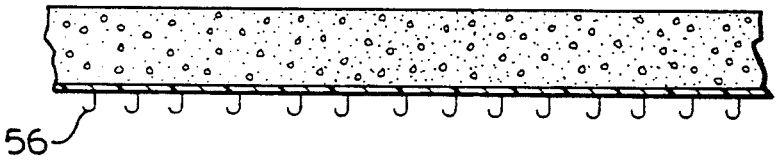
FIG. 6 is a view similar to FIG. 5, the ceiling incorporating the complementary elements of the connecting means combination.
Figure 6:
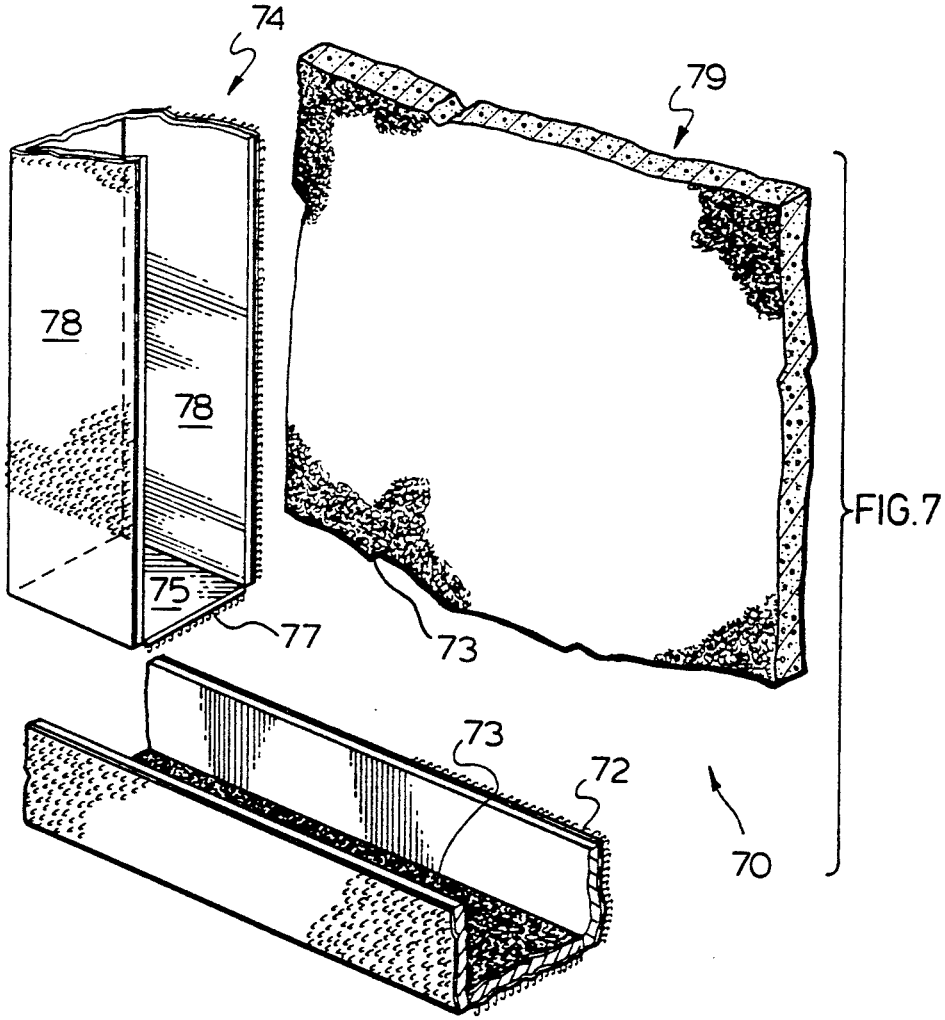

In the case of a poured ceiling surface, as illustrated in FIGS. 5 and 6, respective surface area attachment elements 54, 56 can be secured in situ at the time of pouring the concrete ceiling, or subsequently applied thereto. The enhanced utility achieved in making the surface area elements 54 or 56 as part of the formwork illustrated in FIG. 1, by appropriate adaptations, can be readily appreciated. Thus, in the case of the ceiling embodiment referred to in the FIG. 1 arrangement, a covering 41 may be either releasable so that it does not attach to the concrete or it may include upwardly extending loops or hooks, so as to bond the covering 41 to the undersurface of a ceiling that is poured thereover. It will be understood that the undersurface of covering 41 also is provided with hooks or loops, the selection of loops or hooks being appropriate to the fastening elements incorporated with the finish ceiling surface to be suspended therefrom. Further, fastening elements complementary to the selected elements of the undersurface of covering 41 will be secured to the upper surface of sheathing sheets 18, to enable detachable attachment of covering 41 to sheets 18, to facilitate initial assembly, and subsequent disassembly of the formwork.

Figure 4:
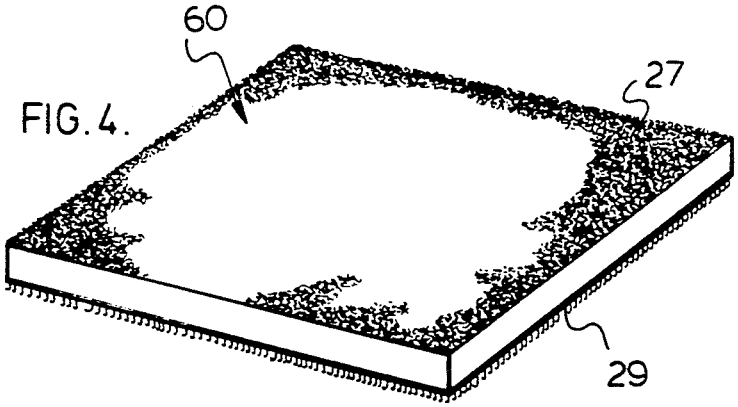

FIG. 4 illustrates a panel 60 having a layer of loop elements 27 and hook elements 29 thereon, for use as an intermediate construction.

In operation, referring first to FIG. 1, a supporting grill work of elements 12, 14, 16 is erected. The presence at the respective interface areas of the hook/loop area attachments permits assembly without nailing or other auxiliary fastening steps. Similarly, the sheathing sheets 18 are readily positioned in place and secured by the weight of the sheeting, together with the temporary application of downward force thereon, to engage the respective loop and hook elements 27, 29.

The barrier sheet 41 protects the upper surface of the sheathing sheets 18 so that liquid concrete cannot penetrate between adjacent sheets 18. This minimizes the need for subsequent joist-flash grinding.

In the case of the sheathing sheet members 18, it is contemplated that they may be fabricated of materials other than Plywood, such as aluminum composites having a foam core, in order to reduce the weight of these members while maintaining adequate structural strength and rigidity.

The barrier sheet 41 may have a treated upper surface thereon, to facilitate bonding with the concrete when it is poured, or a surface barrier layer which precludes such bonding. Also, the upper surface of sheet 41 may have recesses or protrusions, to facilitate in-situ bonding to the poured concrete.

In FIG. 2, suitable floor joists such as the illustrated prefabricated joists are installed at the requisite intervals. The joists 32 may also incorporate area attachment elements in accordance with the present invention at their end lower surfaces to facilitate their installation. The sub-floor panels 40 are then positioned in place where temporary downward force will engage the interface fastener elements, loops 27 and hooks 29.

A protective flexible sheeting 50 then is laid over the sub-floor, so as to cover the intermediate joists 39. The purpose of the sheeting 50 is to protect hook elements 29 of the subfloor panels 40. Once construction activity, such as that of the allied trades, electricians, plumbers, carpenters is completed, a carpet having a looped undersurface in accordance with my copending application Ser. No. 136,953 can be substituted for the sheeting 50.

In dissassembling the subject system it will be understood that, owing to the potentially large securing forces that can be generated between the interface attachment hook and loop means, the use of auxiliary mechanisms, such as pry bars or pulling mechanisms may be required.

Referring to FIG. 7 a portion of a Partition wall assembly 70 is shown. A sill piece 72 of U-section, having fastening elements 73 therein receives a stud member 74 in inserted relation. An end under-face of portion 75 of stud member 74 has fastening elements 77 thereon, to engage the fastening elements 73 of sill piece 72. The side portions 78 of stud member 74 have the outer faces thereof covered or at least partially covered with fastening elements 77, to which the elements 73 of sheet 79 can adhere. In use a partition wall can be readily and rapidly assembled to provide a partition wall of adequate strength, yet which can be readily disassembled. The sill piece 72 may also be provided with attachment elements 73 or 77 on the underface thereof. The partition wall elements 72 and 74 are generally of rolled metal, of thin section, similar to the metal studs and sills presently used with nailing constructions.

It will be understood that the foregoing disclosed embodiments are illustrative of the invention, and modifications thereto can be made, within the scope of the claims appended hereto.

I claim:

1. A building construction for making walls, ceilings or floors comprising:

a structure formed from a settable material having at least one substantial planar first surface, and an overlay covering including, a front surface substantially covered in a part of hook and loop fastening system and an opposing rear surface, wherein, the rear surface of the overlay covering is embedded in the first surface during the manufacture of the structure.

2. The building construction of claim 1, wherein the rear surface has structural means for embedding into the material.

3. The building construction of claim 2, wherein the structural means are a part of a hook and loop fastening system.

4. The building construction of claim 1, wherein the rear surface of the overlay covering is treated to facilitate bonding to the material.

5. The building construction of claim 2, wherein the rear surface of the overlay convering is treated to facilitate bonding to the material.

6. The building construction of claim 3, wherein the overlay convering is supported by a form work, while the settable material is setting, having a complementary part of a hook and loop fastening system detachable from the overlay covering when the material has set.

7. The building construction of claim 3, wherein the structure further comprises a substantially planar second surface opposing the first surface, and a further overlay covering including a front surface substantially covered in a part of a hook and loop fastening system and an opposing rear surface, wherein, the rear surface of the further overlay covering is embedded in the second surface during the manufacture of the structure.

8. A method of constructing a wall, ceiling or floor, the method comprising the steps of:

erecting a form work including:

a sheathing member having a front surface and having a part of a hook and loop fastening system on the front surface; and an overlay covering substantially covered on a front surface thereof with a part of a hook and loop fastening system of complementary attachability to that on the first surface of the sheathing member, and having an opposing rear surface;

wherein the front surface of the overlay covering is fastened to the front surface of the sheathing member through the fastening system;

pouring a settable material against the rear surface of the overlay covering;

setting the material; and dismantling the form work from the structure, including removing the sheathing member.

9. The method of claim 8, wherein the rear surface of the overlay cover has a surface barrier layer to preclude bonding of the overlay cover to the settable material.

10. The method of claim 8, further comprising the step of, embedding a portion of the rear surface of the overlay covering in a first surface of the settable material adjacent to the rear surface.

11. The method of claim 10, wherein that portion of the overlay covering which is embedded in a settable material has structural means on the rear surface of the overlay covering which forms a bond with the settable material when the material sets.

12. The method of claim 11, wherein the structural means are a part of a hook and loop fastening system substantially covering the rear surface of the overlay covering.

13. The method of claim 12, further comprising the step of treating the rear surface of the overlay covering, prior to pouring the material, in order to facilitate bonding to the material.

14. The method of claim 13, wherein the sheathing member has a first surface opposing its front surface, and has a part of a hook and loop fastening system on the first surface, and the form work further includes a support member having a part of a hook and loop fastening system of complementary attachability to the part of the hook and loop fastening system on the first surface of the sheathing member on a second surface, wherein the sheathing member and support member are fastened by their respective parts of the hook and loop fastening system.

* * * * *

UNITED STATES PATENT AND TRADEMARK OFFICE

CERTIFICATE OF CORRECTION

PATENT NO. : 5,133,166

DATED : July 28, 1992

INVENTOR(S) : PACIONE, Joseph R.

It is certified that error appears in the above-identified patent and that said Letters Patent is hereby corrected as shown below:

Claim 1: Col. 6, line 15;

Change "substantial" to --substantially--.

Signed and Sealed this

Twelfth Day of January, 1993

*Attest:*

DOUGLAS B. COMER

*Attesting Officer*

*Acting Commissioner of Patents and Trademarks*